US006891358B2

(12) United States Patent
Marinca

(10) Patent No.: US 6,891,358 B2
(45) Date of Patent: May 10, 2005

(54) BANDGAP VOLTAGE REFERENCE CIRCUIT WITH HIGH POWER SUPPLY REJECTION RATIO (PSRR) AND CURVATURE CORRECTION

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 10 days.

(21) Appl. No.: 10/330,315

(22) Filed: Dec. 27, 2002

(65) Prior Publication Data

US 2004/0124822 A1 Jul. 1, 2004

(51) Int. Cl.[7] ..... G05F 1/575
(52) U.S. Cl. ..... 323/316; 323/315; 323/907
(58) Field of Search ..... 323/907, 316, 323/315, 314, 313

(56) References Cited

U.S. PATENT DOCUMENTS 5,325,045 A 6/1994 Sundby
5,352,973 A * 10/1994 Audy ..... 323/313
5,686,821 A * 11/1997 Brokaw ..... 323/273
5,767,664 A 6/1998 Price
5,917,311 A * 6/1999 Brokaw ..... 323/280
6,489,831 B1 * 12/2002 Matranga et al. ..... 327/512

FOREIGN PATENT DOCUMENTS

EP 1 359 490 A2 11/2003
WO WO 02/08846 A1 1/2002

OTHER PUBLICATIONS

International Search Report from corresponding International Application No. PCT/US03/41309; filed Dec. 24, 2003.

* cited by examiner

*Primary Examiner*—Bao Vu
(74) *Attorney, Agent, or Firm*—Wolf, Greenfield & Sacks, P.C.

(57) ABSTRACT

A voltage reference circuit is provided which includes PTAT and CTAT generating components. The CTAT components are provided in a feedback configuration about an operational amplifier and are combined with PTAT generating components which are coupled to the inputs of the amplifier. The combination of the CTAT and PTAT components is effected in a manner which provides for a temperature curvature correction of the output voltage of the circuit.

13 Claims, 6 Drawing Sheets

BANDGAP VOLTAGE REFERENCE CIRCUIT WITH HIGH POWER SUPPLY REJECTION RATIO (PSRR) AND CURVATURE CORRECTION

FIELD OF THE INVENTION

This invention relates to a bandgap voltage reference circuit and particularly to a temperature compensated bandgap voltage reference circuit with high PSRR, curvature correction and low drop-out.

BACKGROUND TO THE INVENTION

Bandgap voltage reference circuits are well known in the art. They are implemented where it is required to provide a stable voltage supply that is temperature independent over a wide range of operating temperatures. Typically they operate by combining the negative temperature coefficient of an emitter-base voltage (i.e. a CTAT or Complementary To Absolute Temperature voltage) with the positive temperature coefficient of an emitter-base voltage differential of two transistors (i.e. a PTAT or Proportional To Absolute Temperature voltage), the two transistors operating at different current densities, to make a substantially zero temperature coefficient reference voltage.

An example of one such voltage reference circuit is described in *New Developments in IC Voltage Regulators, IEEE Journal of Solid-State Circuits* Vol SC-6 No 1 February 1971, pages 2–7. However one of the problems associated with this traditional voltage reference circuit is that although the bandgap voltage output is independent of temperature to a first order, the output of this standard circuit is found to include a term that varies with TlnT, where T is absolute temperature and "ln" is the natural logarithm function. FIG. 1 is a graph showing an example of the output voltage of such a circuit. It is apparent that the output exhibits a "bow-shape" response. This curvature indicates that the reference voltage does not remain constant over a range of temperatures and therefore fails to achieve the ideal of a temperature independent voltage reference.

A modification to overcome this problem was proposed by Jonathan M. Audy and is described in U.S. Pat. No. 5,352,973, assigned to the assignee of the present invention. In this patent Audy describes how to cancel the curvature by compensating for the TlnT term. It is achieved by adding a correction circuit to the standard bandgap implementation. FIG. 2 shows the circuit as implemented by Audy. The circuit to the right of the dotted line is a standard bandgap circuit with the two transistors Q1 and Q2 operating with PTAT current. The curvature cancellation circuit is shown to the left of the dotted line. In this circuit, transistor Qc1 is identical to Q2 in the main circuit, but it operates with constant current via the amplifier A2. It will be understood that as the two transistors Q2 and Qc1 are operating at the same base-emitter voltage, and Q2 is operating with PTAT current while Qc1 is operating at constant current, the result is a voltage between the two emitters of the form TlnT. This voltage generates a current through Rc, and this is the correction current.

While this aforementioned circuit substantially eliminates the curvature effect in the output voltage, there is one drawback associated with its implementation. It can be seen that as the correction transistor's terminals are connected to the inverting and non-inverting inputs, and the output of the operational amplifier, it clearly requires free voltage movement on each of the transistor's three terminals for operation. In a standard CMOS process generally only two types of bipolar transistors are available—a parasitic substrate bipolar transistor device with one terminal permanently connected to the substrate, and a lateral bipolar transistor device which has very poor performance. Therefore this implementation could not be directly implemented in standard CMOS.

Therefore there exists a need to provide a circuitry and method adapted to overcome this problem associated with the prior art.

SUMMARY OF THE INVENTION

These needs and others are addressed by the curvature correction scheme of the present invention which provides for a bandgap voltage reference circuit implemented in CMOS technology.

According to a first embodiment of the present invention a bandgap voltage reference circuit having a supply voltage and adapted to provide an output voltage reference having a temperature curvature correction is provided. The circuit comprises an operational amplifier, having an inverting input node, a non-inverting input node, and an output node. A first set of circuit components are coupled to the operational amplifier and are adapted to generate a PTAT (Proportional to Absolute Temperature) current at the input nodes of the operational amplifier. A second set of circuit components, adapted to generate a CTAT (Complementary to Absolute Temperature) current, are provided in a feedback configuration so as to couple the output node of the operational amplifier to the input nodes of the operational amplifier. The PTAT and CTAT currents generated by the first and the second set of circuit components are combined at the input nodes of the operational amplifier so as to provide for temperature curvature correction of the output voltage at the output node, thereby providing the voltage reference at an output voltage reference node.

Desirably, the first set of circuit components and second set of circuit components are coupled to the output voltage reference node. The first set and second set of circuit components may also be isolated from the supply voltage.

Typically, the first set of circuit components include a first pair of stacked transistors coupled to the inverting input node of the operational amplifier, and a second pair of stacked transistors coupled to the non-inverting input node of the operational amplifier, the first and second stacked transistors pairs being scaled in area so as to generate a PTAT voltage between the first stacked transistor pair and the second transistor pair, the PTAT voltage providing the PTAT current at the input nodes of the operational amplifier.

The first set of circuit components may further include a first resistor and a second resistor, the first resistor being provided between the common node of the second stacked transistor pair and ground, and the second resistor being provided between the output node of the operational amplifier and the common node of the second stacked transistor pair. In such a configuration the values of the first and second resistors are typically equal, thereby ensuring that the transistors of the second stacked transistor pair operate with PTAT currents.

The first set of circuit components may further include a third and a fourth resistor, the third resistor coupled between the output node of the operational amplifier and the inverting node of the operational amplifier, and the fourth resistor coupled between the inverting node and the first stacked transistor pair, and wherein the ratio of the values of the third to the fourth resistor is an integer ratio, thereby reducing mismatch, and ensuring that the output voltage is as accurate as possible.

The second set of circuit components are typically arranged to provide a CTAT current at the common node of the first stacked transistor pair.

The second set of circuit components may further provide a PTAT current at the common node of the first stacked transistor pair.

In a preferred embodiment the second set of circuit components include a current mirror. Desirably a third stacked transistor pair may be provided within the second set of circuit components, the current mirror being coupled to the output node of the operational amplifier and the common node of the third stacked transistor pair is coupled to one terminal of the current mirror, such that the second set of circuit components provides a combination of PTAT and CTAT currents at the common node of the first stacked transistor pair, the CTAT current being provided by an output current generated from the current mirror and the PTAT current being provided by an output current generated from the third stacked transistor pair.

The second set of circuit components desirably has a first set of current mirrors and a second set of current mirrors, the first set of current mirrors providing the current at the common node of the first stacked transistor pair, and the second set of current mirrors providing a current at the inverting node of the operational amplifier, the coupling of the first and second set of current mirrors to their respective nodes providing an adjustment of the voltage at the output node of the operational amplifier to the desired value.

In such an embodiment the second set of circuit components may further include a fifth resistor coupled between the first set of current mirrors and ground, the first, second and fifth resistors adapted to provide the temperature curvature correction of the output voltage.

These and other features of the present invention will be better understood with reference to the following drawings and description.

DETAILED DESCRIPTION OF THE DRAWINGS

Figure 1:
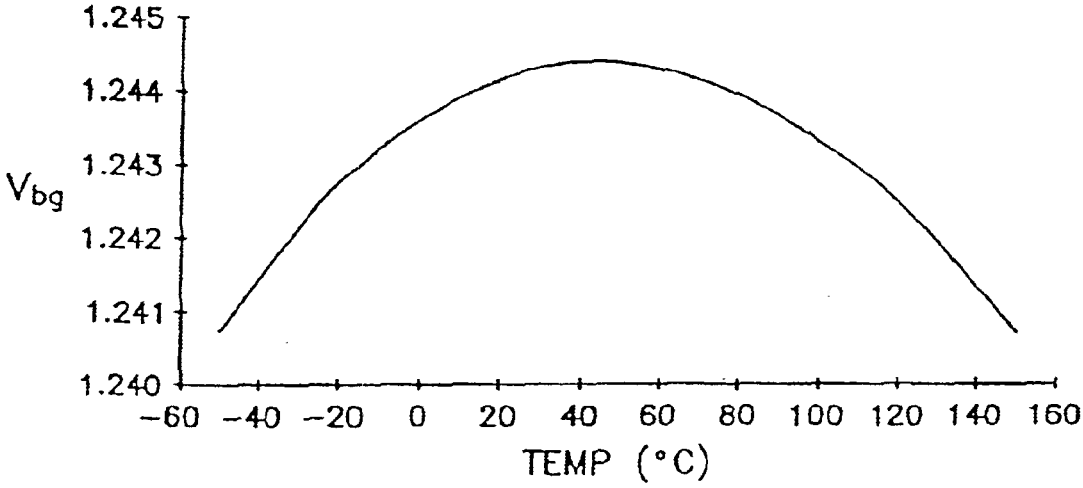
FIGURE 1 (PRIOR ART)
FIG. 1 is a graph of a typical TlnT temperature deviation for a basic bandgap voltage reference circuit.
Figure 2:
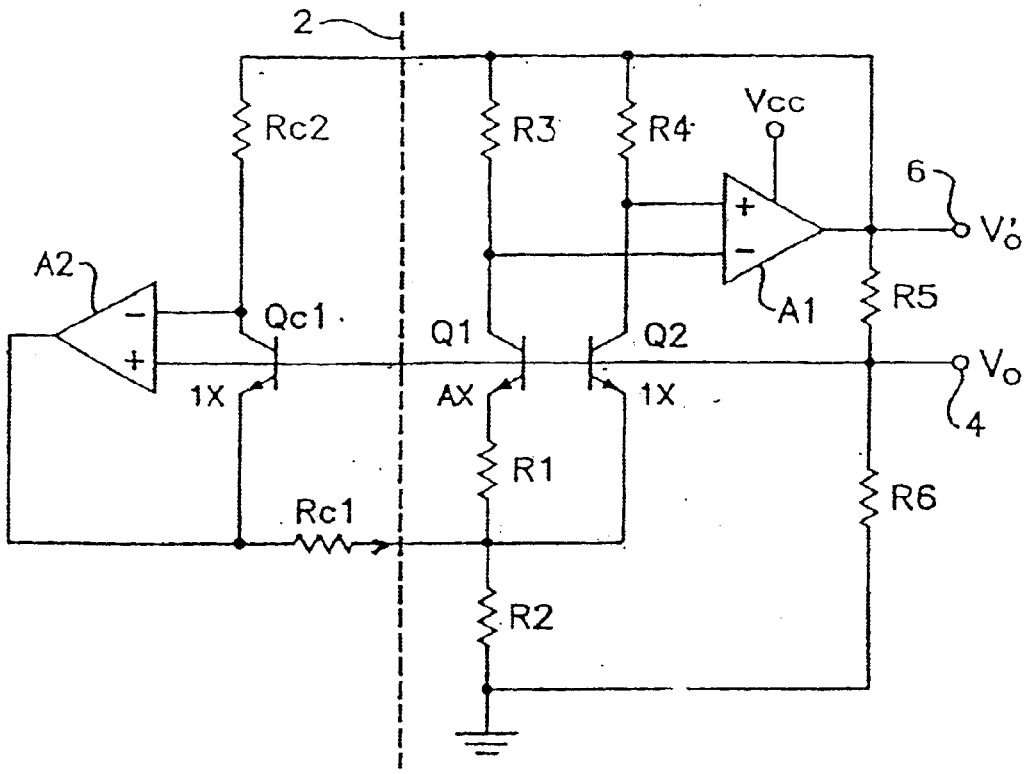
FIGURE 2 (PRIOR ART)
FIG. 2 is a schematic diagram of a known bandgap voltage reference circuit that substantially compensates for the temperature deviation in the basic bandgap voltage reference circuit.

FIGS. 1 and 2 have been described with reference to the prior art.

Figure 3:
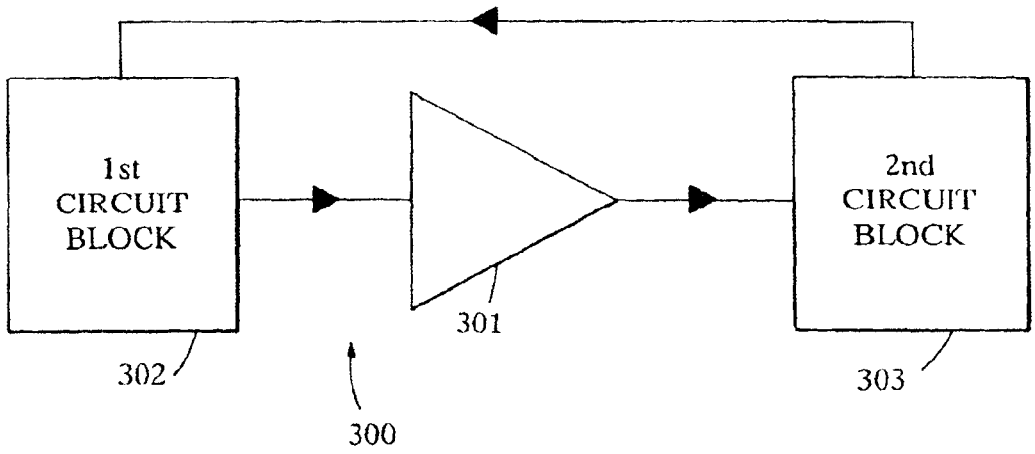
FIG. 3 is a block diagram of the structure of a circuit providing for compensation in temperature deviation according to the present invention.

FIG. 3 shows a block diagram 300 of the circuit of the present invention adapted so as to compensate for temperature deviation in the reference voltage. It comprises an operational amplifier 301, a first circuit block 302, and a second circuit block 303. The first circuit block 302 includes a first set of circuit components configured so as to provide a bandgap voltage reference circuit, when coupled to the input nodes of an operational amplifier 301. Desirably this bandgap voltage reference circuit generates a PTAT current at the input nodes of the operational amplifier 301. According to the present invention, a second circuit block 303 is coupled to the output node of the operational amplifier 301 so as compensate for the temperature curvature component which is typically present in a bandgap voltage reference circuit. The second circuit block 303 includes a second set of circuit components which are provided in a feedback configuration so as to couple the output node of the operational amplifier 301 to the input nodes of the operational amplifier via the first circuit block 302. The second set of circuit components are adapted to generate at least a CTAT current, and in some embodiments of the present invention, a PTAT current may also be provided. In accordance with the present invention the PTAT and CTAT currents generated by the first and second set of circuit components are combined at the input nodes of the operational amplifier in a manner so as to provide for temperature curvature correction of the output reference voltage at the output node.

Figure 4:
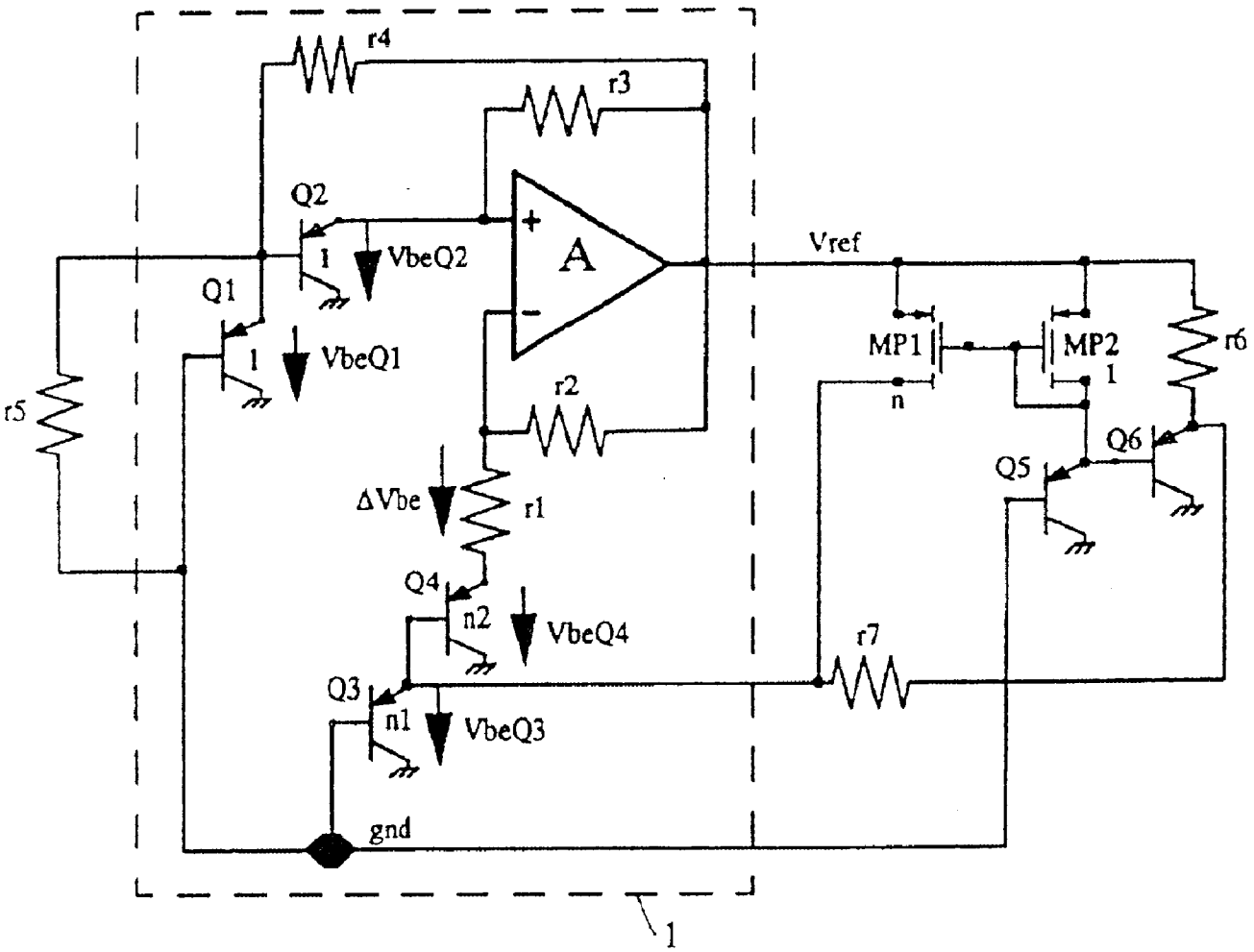
FIG. 4 is a schematic diagram of a first embodiment of a circuit providing for compensation in temperature deviation according to the present invention.
Figure 5:
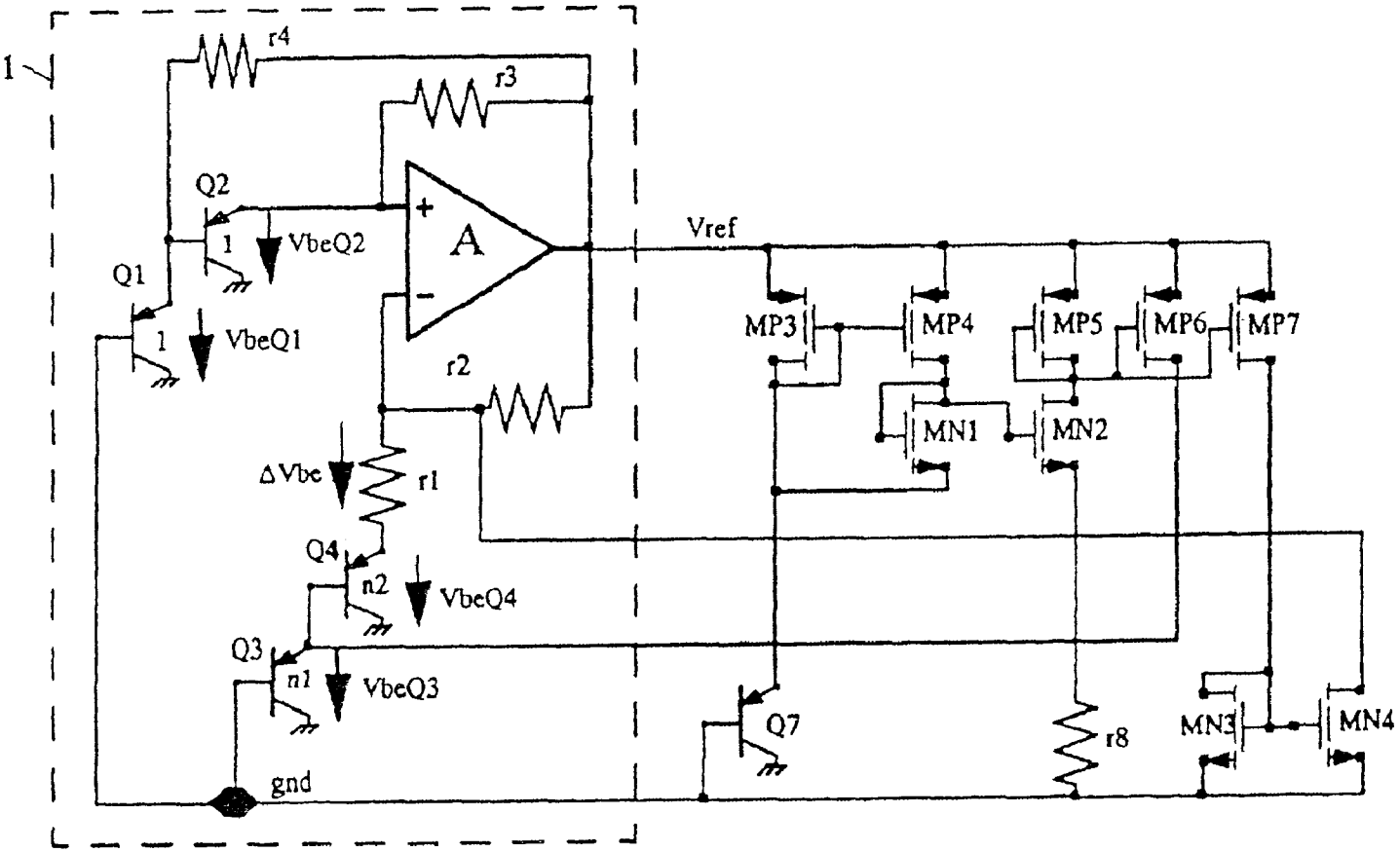
FIG. 5 is a schematic diagram of a second embodiment according to the present invention.
Figure 6:
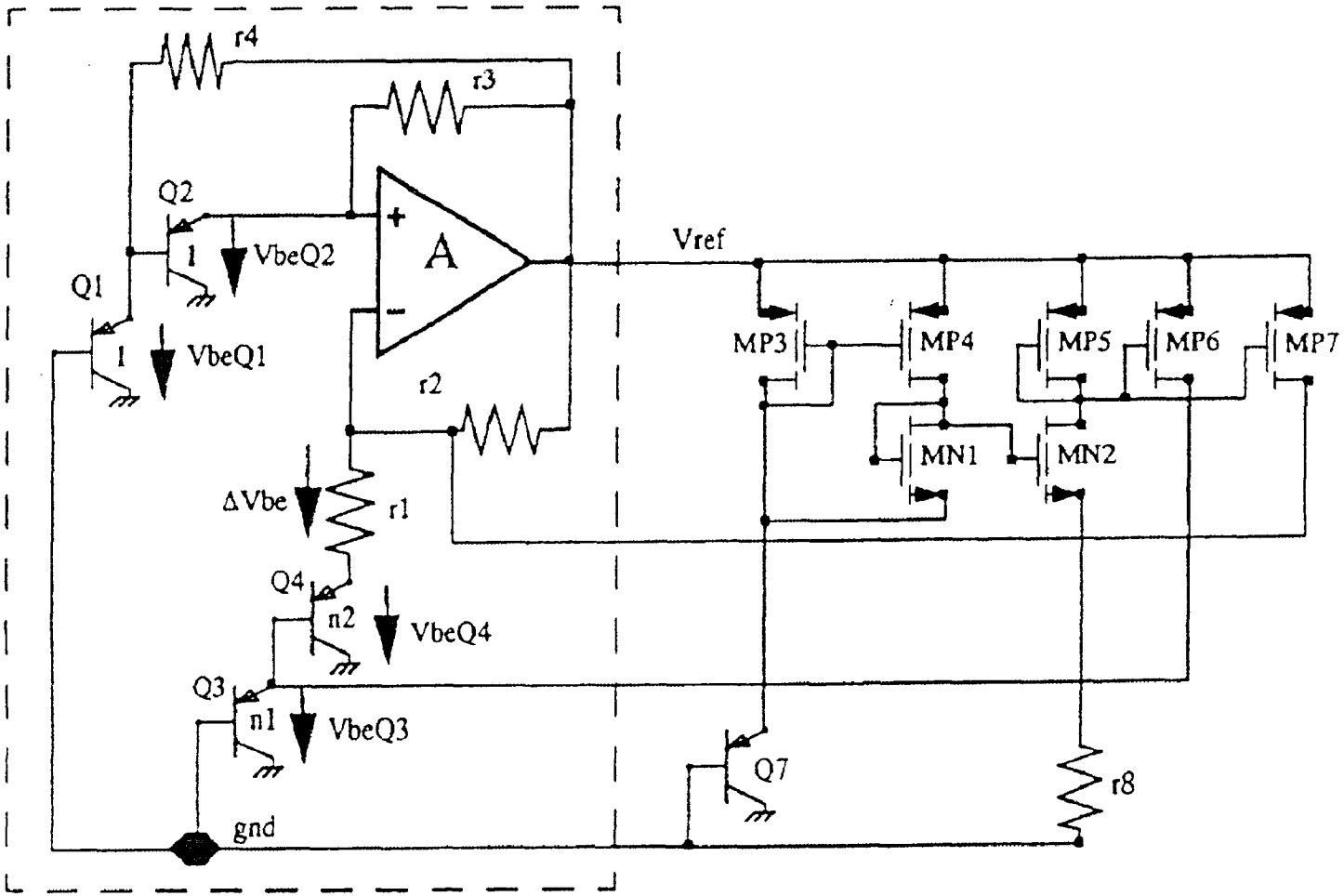
FIG. 6 is a schematic diagram of a third embodiment according to the present invention.

This invention will now be further described with reference to the accompanying drawings in which FIGS. 4 to 6 are exemplary embodiments of circuits, according to the invention, adapted to effect a correction of the curvature that is traditionally present in the output of bandgap voltage reference circuits, and implemented in CMOS technology. The schematic blocks of the first 302 and second 303 circuits shown in FIG. 3 will be described with reference to basic bandgap circuits and the correction circuits provided so as to effect a temperature curvature correction.

Shown enclosed in the dashed box 1 of FIG. 4 is the basic bandgap voltage reference circuit that is subject to the temperature curvature deviation as described above in the section "background to the invention". It consists of four transistors Q1, Q2, Q3 and Q4, an op amp A and resistors r1, r2, r3, r4. In accordance with this embodiment of the invention, and as shown outside of the dashed box, a correction circuit is added to the basic bandgap voltage reference circuit to achieve curvature correction.

The correction circuit comprises two PMOS transistors, MP1 and MP2, two bipolar transistors Q5 and Q6 and three resistors, r5, r6 and r7. The gates of MP1 and MP2 are connected together, with the gate of MP1 also shorted to the emitter of Q5. MP1 and MP2 usually operate with different drain currents. Both sources of MP1 and MP2 are connected to the voltage reference output, Vref of the amplifier A. The drain of MP1 is connected to the emitter of Q3. The emitter of Q5 is also connected to the base of Q6. r6 is connected between Vref and the emitter of Q6. The emitter of Q6 is connected to the emitter of Q3 via r7. The base of Q5 is grounded. The collectors of both Q5 and Q6 are also grounded. r5 is connected between the base and emitter of Q1.

In the standard voltage reference circuit, transistors Q1, Q2, Q3 and Q4 are usually biased with PTAT currents. However, the addition of the correction circuit of the present invention introduces a CTAT current into this circuit.

With reference to the circuit of FIG. 4, it can be shown that if $r_2=4r_1$ the output reference voltage of the amplifier is given as $$V_{ref} = V_{beQ1} + V_{beQ2} + \frac{r_2}{r_1}\Delta V_{be} = V_{beQ1} + V_{beQ2} + 4\Delta V_{be} \tag{1}$$

where $$\Delta V_{be}=V_{beQ1}+V_{beQ2}-V_{beQ3}-V_{beQ4} \tag{2}$$

The relationship between $\Delta V_{be}$ and temperature is known, from standard techniques, to be defined as $$\Delta V_{be} = \Delta V_{be0}\frac{T}{T_0} \tag{3}$$

where T is the operating temperature, $T_0$ is an arbitrary reference temperature and $\Delta V_{be0}$ is $\Delta V_{be}$ at $T_0$.

It can also be shown that for a single transistor operating with PTAT current the base-emitter is voltage is $$V_{be1} = V_{g0} - (V_{g0} - V_{be10})\frac{T}{T_0} - (\sigma - 1)\frac{kT}{q}\ln\frac{T}{T_0} \tag{4}$$

where $V_{g0}$ is the bandgap voltage extrapolated to absolute zero temperature 0 degrees K, σ is the saturation current temperature exponent, k is Boltzmann's constant, $V_{be10}$ is $V_{be1}$ at $T_0$, and q is the electron charge.

It can be understood and observed from the circuit of FIG. 4 that the emitter current of transistor Q5 which is set by MOSFET MP2 is $$I_{Q5e} = \frac{\beta}{2}(V_{be1} + 4\Delta V_{be} - V_T)^2 \tag{5}$$

where β is the conduction parameter of the MOSFET.

This can be rewritten, by substituting for equation (4) and neglecting its last term, as:

$$I_{Q5e} = \frac{\beta}{2}\left(V_{G0} - V_T - (V_{G0} - V_{be10} - 4\Delta V_{be0})\frac{T}{T_0}\right)^2 \tag{6}$$

It will be appreciated that this current has three components: one temperature independent, one proportional to T (PTAT) and one being proportional to $T^2$. The main contribution will be understood as arising from the component providing a PTAT current.

It can be seen that as the aspect ratio of MP1 is "n" times that of MP2, the drain current of MP1 is scaled "n" times $I_{Q5e}$. It will be understood that the current through the emitter of Q3 will be the sum of the drain current of MP1 and the current flowing through resistor r7. If Q1, Q2, Q3, Q4 have the same emitter area and n1=n2 then:

$$I_{Q3e} = \frac{V_{be1} + \frac{1}{2}\Delta V_{be}}{r_7} + \frac{I_{Q5e}}{n} \tag{7}$$

This emitter current is a combination of CTAT and PTAT currents, as $V_{be1}$ is a CTAT voltage, $\Delta V_{be}$ is a PTAT voltage and $I_{Q5c}$ is substantially a PTAT current. If the PTAT and CTAT components are well balanced then the emitter current of Q3 is temperature independent. We can also see from the circuit of FIG. 4 that if r4=r5 then:

$$I_{Q1e} = I_{r4} - I_{r5} = \frac{2V_{be1} + 4\Delta V_{be} - V_{be1}}{r_4} - \frac{V_{be1}}{r_5} = \frac{4\Delta V_{be}}{r_4}; \tag{8}$$

-continued $$I_{Q2e} = I_{r3} = \frac{4\Delta V_{be}}{r_3} \text{ and}$$

$$I_{Q4e} = I_{r1} = \frac{\Delta V_{be}}{r_1}$$

It will be appreciated that as these currents are of the form $\Delta V_{be}$, each of these currents are PTAT currents.

Substituting these equations (8) into equation (2) we get $$\Delta V_{be} = \frac{kT}{q}\ln\frac{4^2\Delta V_{be0}\frac{T}{T_0}}{\left(2V_{be1} + \Delta V_{be} + \frac{2r_7}{n}I_{Q5e}\right)}\frac{2r_1r_7}{r_3r_4}n_1n_2 = \frac{kT}{q}\ln\left(\frac{4^2\Delta V_{be0}}{\left(2V_{be1} + \Delta V_{be} + \frac{2r_7}{n}I_{Q5e}\right)}\frac{2r_1r_7}{r_3r_4}n_1n_2\right) + \frac{kT}{q}\ln\left(\frac{T}{T_0}\right) \tag{9}$$

As Eq. (9) shows, $\Delta V_{be}$ has two components, one PTAT of the form of $K_1T$ and the second one of the form of $K_2T\ln T$.

Returning to the original equation (1) for Vref and substituting from equation (9) and equation (4), Vref can be rewritten as:

$$V_{ref} = 2V_{be1} + 4\Delta V_{be} = 2V_{g0} - 2\frac{T}{T_0}(V_{g0} - V_{be10}) - 2(\sigma - 1)\frac{kT}{q}\ln\frac{T}{T_0} + 4\Delta V_{be} \tag{10}$$

It can be seen that by properly scaling the PTAT, CTAT and curvature components in equation (10) we obtain:

$$V_{ref} = 2V_{g0}$$

It is clear from this equation that the output voltage curvature term has been removed.

It should be noted that resistor r5 should be chosen to equal r4 to ensure that Q1 operates with a PTAT current. The resistor ratio $$\frac{r2}{r1}$$

should also be chosen to give an integer ratio, as this reduces mismatch.

One of the advantages of the described circuit is that all the currents generating $V_{be}$ and $\Delta V_{be}$ are generated from the constant output voltage instead of the supply voltage. This results in Power Supply Rejection Ratio (PSRR) figures of over 100 dB. Another advantage is that the cell is inherently buffered with a very low output impedance and also has very low noise. It will be appreciated that the curvature correction provided in this first embodiment utilises a plurality of resistors. Although this does provide for a correction circuit, this architecture is not suitable for all implementations, especially those implementations where size is at a premium.

FIG. 5 shows a second embodiment of the invention which is exemplary of the type of modification that can be made to reduce the area required for implementation, yet still provides for a correction in curvature. The same reference numerals are used for components, which are present in both embodiments.

This second embodiment provides for the replacement of the resistors r5, r6, r7 which are described in FIG. 4 by a current mirror architecture, which serves to provide the same functionality albeit in a different manner. As was used previously with respect to FIG. 4, the circuit can be considered in terms of a correcting and non-correcting set of components for ease of explanation. Shown within the dashed box is the basic bandgap voltage reference as before. It consists of four bipolar transistors Q1, Q2, Q3 and Q4, four resistors r1, r2, r3 and r4 and an op-amp A.

In accordance with this second embodiment of the invention, shown outside the dashed box is a correction circuit, which is added to this basic bandgap voltage reference circuit to achieve curvature correction. It comprises five PMOS transistors MP3, MP4, MP5, MP6 and MP7, four NMOS transistors MN 1, MN2, MN3 and MN4, one bipolar transistor Q7 and a resistor r8.

The source of each of MP3, MP4, MP5, MP6 and MP7 are connected to the voltage reference output, Vref of the op-amp A. MP3 and MP4 are arranged as a current mirror, with their gates connected together and the drain of MP3 connected to its gate. MN1 and MN2 are connected as a current mirror, with their gates connected together and the drain of MN1 connected to its gate. MP5, MP6 and MP7 are connected as a two output current mirror, with the gates of MP5, MP6 and MP7 all connected together and the drain of MP5 connected to its gate terminal. MN3 and MN4 are connected as a current mirror, with their gates connected together and the drain of MN3 connected to its gate. The drain of MP4 is connected to the drain of MN1. A resistor r8 is connected at one end to the source of MN2 and at the other end to ground. Both the drain of MP3 and the source of MN1 are connected to the emitter of Q7.

The collector and base terminals of Q7 are grounded. The drain of MP5 is connected to the drain of MN2. The drain of MP6 is connected to the emitter of Q3. The drain of MP7 is connected to the common gate of MN3 and MN4. The source of MN3 and MN4 are connected to ground. The drain of MN4 is connected to the inverting input of the amplifier A. All body terminals for the PMOS are connected to their respective source terminals.

With reference to this circuit of FIG. 5, it can be shown that a CTAT voltage is developed across Q7. Due to the current mirror configuration between MP3 and MP4 and between MN1 and MN2 a corresponding CTAT voltage is developed across resistor r8. This causes the drain current of MN2 and MP5 to be a CTAT current. This CTAT current is mirrored in the drain of MP6 and MP7. The CTAT current flowing in the drain of MP6 is pushed into the emitter of Q3. The CTAT current flowing in the drain of MP7 flows towards the drain of MN3, where it is mirrored as the drain current of MN4. Thus the drain current of MN4 pulls a CTAT current from the inverting node of the amplifier A in order to adjust the reference voltage Vref to a desired value.

It will be appreciated therefore that the current flowing through the resistor r2 is a combination of PTAT and CTAT currents, but predominantly PTAT. The output voltage of the op amp can be shown therefore to be:

$$V_{ref} = V_{beQ1} + V_{beQ2} + \Delta V_{be}\frac{r_2}{r_1} + V_{beQ2}\frac{r_2}{r_8} \tag{11}$$

which is a combination of PTAT and CTAT voltages. By properly scaling the resistors ratio of, $r_1$, $r_2$ and $r_8$, the reference voltage will be temperature independent, as per the first embodiment. The CTAT current pulled out from the feedback resistor $r_2$ will give the opportunity to shift the reference voltage to a higher value than that of the first embodiment of FIG. 4.

It should be noted that in this second embodiment, Q1 is operating with a current which is a combination of PTAT and CTAT currents, rather than pure PTAT as in the first embodiment. As a result, in order to maintain the cancellation of the curvature it is necessary to operate Q3 with a current which is CTAT rather than a mixture of PTAT and CTAT as in the first embodiment. This is effected by the connection of the components in the correction circuit, with the drain of MOSFET MP6 connected to the emitter of Q3.

It will be appreciated by those skilled in the art that, due to the reduced numbers of resistors used, the second embodiment requires less area than the first embodiment. The implementation is also more flexible as there is no such requirement similar to that in the first embodiment where it was necessary for r4 to equal r5. In exemplary embodiments of the invention the first embodiment provides a fixed reference voltage of about 2.3V, while the second embodiment provides a reference voltage that can be adjusted to a typical value of 2.5V.

A third embodiment shown in FIG. 6 provides a reference voltage that can be reduced below 2.3V. The circuit operation of the third embodiment is similar to the second embodiment, except that instead of subtracting a CTAT current from the inverting node of the amplifier A, it injects a CTAT current generated by MP7 into the same node. This has the effect of lowering the reference voltage.

By similar analysis to the second embodiment it can be shown that in the third embodiment the reference voltage is given by:

$$V_{out} = 2V_{beQ1} + \Delta V_{be}\frac{r_2}{r_1} - V_{beQ7}\frac{r_2}{r_8} \tag{12}$$

It will be appreciated by those skilled in the art that the third embodiment is useful where a reference of less than 2.3V is required. For example many applications require a reference voltage of 2.048V, which may be provided by circuitry.

It will be appreciated that the present invention provides for a temperature compensated voltage band gap reference circuit that may be implemented in CMOS technology. In accordance with the present invention the generation of a CTAT current in a feedback loop from the output of an operational amplifier may be used in combination with a PTAT current at the input of the operational amplifier so as to correct for any temperature curvature. Three preferred embodiments have been described and it will be appreciated that the embodiments are exemplary of the application of the concepts of the present invention and it is not intended to limit the present invention in any manner except as may be required in the light of the accompanying claims.

The words "comprises/comprising" and the words "having/including" when used herein with reference to the present invention are used to specify the presence of stated features, integers, steps or components but does not preclude the presence or addition of one or more other features, integers, steps, components or groups thereof.

What is claimed is:

1. A bandgap voltage reference circuit having a supply voltage and adapted to provide an output voltage reference having a temperature curvature correction, comprising:

an operational amplifier, having an inverting input node, a non-inverting input node, and an output node, the circuit including:

a first set of circuit components coupled to the operational amplifier and adapted to generate a PTAT (Proportional to Absolute Temperature) current at the input nodes of the operational amplifier, a second set of circuit components provided in a feedback configuration and coupling the output node of the operational amplifier to the input nodes of the operational amplifier, the second set of circuit components adapted to generate a CTAT (Complementary to Absolute Temperature) current, and wherein the PTAT and CTAT currents generated by the first and the second set of circuit components are combined at the input nodes of the operational amplifier so as to provide for temperature curvature correction of the output voltage at the output node, thereby providing the voltage reference at an output voltage reference node.

2. A bandgap voltage reference circuit according to claim 1, wherein the first set of circuit components and second set of circuit components are coupled to the output voltage reference node.

3. A bandgap voltage reference circuit according to claim 1, wherein the first set of circuit components and second set of circuit components are isolated from the supply voltage.

4. A bandgap voltage reference circuit according to claim 3, wherein the first set of circuit components includes a first pair of stacked transistors coupled to the inverting input node of the operational amplifier, and a second pair of stacked transistors coupled to the non-inverting input node of the operational amplifier, the first and second stacked transistors pairs being scaled in area so as to generate a PTAT voltage between the first stacked transistor pair and the second transistor pair, the PTAT voltage providing the PTAT current at the input nodes of the operational amplifier.

5. A bandgap voltage reference circuit according to claim 4, wherein the first set of circuit components further includes a first resistor and a second resistor, the first resistor being provided between the common node of the second stacked transistor pair and ground, and the second resistor being provided between the output node of the operational amplifier and the common node of the second stacked transistor pair.

6. A bandgap voltage reference circuit according to claim 5 wherein the values of the first and second resistors are equal, thereby ensuring that the transistors of the second stacked transistor pair operate with PTAT currents.

7. A bandgap voltage reference circuit according to claim 6, wherein the first set of circuit components further includes a third and a fourth resistor, the third resistor coupled between the output node of the operational amplifier and the inverting node of the operational amplifier, and the fourth resistor coupled between the inverting node and the first stacked transistor pair, and wherein the ratio of the values of the third to the fourth resistor is an integer ratio, thereby reducing mismatch, and ensuring that the output voltage is as accurate as possible.

8. A bandgap voltage reference circuit according to claim 7 wherein the second set of circuit components provides a CTAT current at the common node of the first stacked transistor pair.

9. A bandgap voltage reference circuit according to claim 8 wherein the second set of circuit components further provides a PTAT current at the common node of the first stacked transistor pair.

10. A bandgap voltage reference circuit according to claim 5 wherein the second set of circuit components includes a current mirror.

11. A bandgap voltage reference circuit according to claim 10 wherein the second set of circuit components further includes a third stacked transistor pair, wherein the current mirror is coupled to the output node of the operational amplifier and the common node of the third stacked transistor pair is coupled to one terminal of the current mirror, such that the second set of circuit components provides a combination of PTAT and CTAT currents at the common node of the first stacked transistor pair, the CTAT current being provided by an output current generated from the current mirror and the PTAT current being provided by an output current generated from the third stacked transistor pair.

12. A bandgap voltage reference circuit according to claim 10 wherein the second set of circuit components has a first set of current mirrors and a second set of current mirrors, the first set of current mirrors providing the current at the common node of the first stacked transistor pair, and the second set of current mirrors providing a current at the inverting node of the operational amplifier, the coupling of the first and second set of current mirrors to their respective nodes providing an adjustment of the voltage at the output node of the operational amplifier to the desired value.

13. A bandgap voltage reference circuit according to claim 12 wherein the second set of circuit components further includes a fifth resistor coupled between the first set of current mirrors and ground, the first, second and fifth resistors adapted to provide the temperature curvature correction of the output voltage.

* * * * *